US006030501A

United States Patent [19]

Neun et al.

[11] Patent Number: 6,030,501

[45] Date of Patent: Feb. 29, 2000

[54] PAPER FORMING ACTIVITY BLADE

[75] Inventors: John A. Neun, Clifton Park; Jeffrey P. Bachand, Queensbury; Keith Carlton, Glens Falls; Daniel Grogan, Greenwich, all of N.Y.

[73] Assignee: Thermo Fibertek Inc., Waltham, Mass.

[21] Appl. No.: 09/267,473

[22] Filed: Mar. 11, 1999

Related U.S. Application Data

[60] Division of application No. 08/903,623, Jul. 31, 1997, Pat. No. 5,932,072, which is a continuation-in-part of application No. 08/837,755, Apr. 22, 1997, Pat. No. 5,922,173.

[51] Int. Cl.[7] ..... D21F 1/54

[52] U.S. Cl. ..... 162/352; 162/354; 162/374

[58] Field of Search ..... 162/351, 352, 162/374, 354

[56] References Cited

U.S. PATENT DOCUMENTS

| | | | |
|---|---|---|---|
| 4,004,969 | 1/1977 | Beauchemin | 162/374 |
| 4,687,549 | 8/1987 | Kallmes | 162/352 |
| 4,789,433 | 12/1988 | Fuchs | 162/352 |
| 5,437,769 | 8/1995 | Bando | 162/301 |
| 5,830,322 | 11/1998 | Cabrera Caram et al. | 162/352 |

*Primary Examiner*—Karen M. Hastings

*Attorney, Agent, or Firm*—Kane, Dalsimer, Sullivan and Levy, LLP

[57] ABSTRACT

A papermaking apparatus such as a Fourdrinier table which includes a long blade and a trail blade. In the first aspect of the invention, the long blade includes an upper undulated surface with vents passing from the upper undulated surface to the lower surface of the long blade which is at substantially atmospheric pressure. In the second aspect of the invention, the trail blade includes an elevator-type device for adjusting the vertical position of the trail blade. In a third aspect of the invention, a single elevator is used to adjust the angle of the blade, the blade is provided as a modular or multiple-piece design, mounting buttons are used to engage slots of T-shaped cross section in the blade and/or ceramic inserts are included at wear points.

4 Claims, 8 Drawing Sheets

PAPER FORMING ACTIVITY BLADE

This application is a divisional of application Ser. No. 08/903,623, filed Jul. 31, 1997, now U.S. Pat. No. 5,932,072, which is a continuation-in-part of application Ser. No. 08/837,755, filed Apr. 22, 1997 now U.S. Pat. No. 5,922,173.

BACKGROUND OF THE INVENTION

1. Field of the Invention

First and second aspects of this invention relates to the creation of stock activity and the control of drainage in a Fourdrinier table, particularly by the use of lifting variable inertial stimulation blades which can further include limited-vent indented surfaces.

Additionally, a third aspect of this invention relates to the variable tilting of the inertial stimulation blades, the inertial stimulation blades being provided in component pieces, the use of ceramic inserts at wear points of the inertial stimulation blades, and the use of button or disk-based mounting apparatus for the inertial stimulation blades.

2. Description of the Prior Art

Stock activity in the early part of a Fourdrinier table is critical to the production of a good sheet of paper. Generally, stock activity can be defined as turbulence in the fiber-water slurry on the forming fabric. This turbulence takes place in all three dimensions. Activity plays a major part in developing good formation by impeding stratification of the sheet as it is formed, by breaking up fiber flocs, and by causing fiber orientation to be random. Typically, stock activity quality is inversely proportional to water removal from the sheet. That is, activity is typically enhanced if dewatering is retarded. As water is removed, activity becomes more difficult because the sheet becomes set, and because water, which is the primary media in which the activity takes place, becomes scarcer. Good paper machine operation is therefore a balance between activity and drainage.

There are a number of conventional methods to promote activity and drainage. A table roll causes a large positive pressure pulse to be applied to the sheet resulting from water under the forming fabric being forced into the incoming nip formed by the roll and forming fabric. This positive pulse has a positive effect on stock activity by causing flow perpendicular to the sheet surface. Similarly, on the exiting side of the roll, large negative pressures are generated, which greatly enhance drainage. Table rolls are generally limited to relatively slow machines because at high speeds, the positive and negative pulse amplitudes become excessively large. Foils are used to promote and control activity and drainage. A vacuum pulse is generated by the nip formed by the forming fabric and conventional foil as the fabric passes over the foil. Activity is generated by using a number of consecutively placed foils, encouraging a positively reinforced activity in the stock. Another type of foil, sometimes referred to as a "posi-blade", incorporates a positive incoming nip to generate a positive and negative pressure pulse. The amplitude of the pressure pulse is determined in a large part by the angle formed by the fabric and the incoming edge of the foil. This type of foil simulates a table roll, but with much lower amplitude positive and negative pressure pulses. The amplitudes are determined by the speed of the machine and the angles of the foils.

Often, Fourdrinier tables are mechanically shaken to promote stock activity, especially on slower, narrower machines. While the shaking might be a good way to enhance formation it is undesirable because it is difficult and expensive to control and maintain, and generally punishing on the equipment on and around the Fourdrinier Table. For paper making in general, most activity inducing systems have the negative feature of excessive drainage.

In patent application Ser. No. 08/600,833, entitled "Velocity Induced Drainage Method and Unit", filed on Feb. 12, 1996, now U.S. Pat. No. 5,437,769 discloses an alternate way of creating activity and drainage. The apparatus disclosed therein, and illustrated herein as FIG. 1, decouples activity and drainage and therefore provides independent control and optimization of activity and drainage. The device typically uses a long blade with a controlled, at least partially non-flat or undulated, surface to induce initial activity in the sheet, and limits the flow downstream of the blade through placement of a trail blade to control drainage. Drainage is enhanced if the area between the long blade, the forming fabric and trail blade remains flooded and surface tension is maintained between the water above and below the fabric. However, the implementation of this device has revealed phenomena previously not fully appreciated. The first occurs in the "counterflow zone" over the long blade, particularly at the undulated portion, where the incompressible fluid is pumped through the forming fabric. This was expected. However, the second activity is much more vigorous and had not been fully appreciated. As the forming fabric spans the relatively long distance between the lead edge of the long blade and the trail blade, it deflects downwardly because of the forces acting on it. These forces are gravitational and also result from the vacuum induction as the fabric travels along the long blade. The latter predominates by far. The wire takes on the shape of a skewed catenary as the forces are asymmetrical along the wire between the support points. If the long blade is high enough or the fabric deflection is severe enough, the wire will contact the long blade and the catenary shape will be further distorted. The activity is induced when the fabric reaches the trail blade. The fabric path must make a rapid transition from the deflected state to the horizontal state very quickly at the leading edge of the trail blade because of the high tensions acting on the fabric path. The fabric path therefore changes sharply as the fabric travels around the sharp leading edge of the trail blade. Inertial forces prevent the fluid slurry of the paper sheet from following the fabric, and inertial activity is induced as the sheet lifts vertically.

Additionally, as the foils are typically made of HDPE (or any other suitable material as would be known to one skilled in the art), any introduction of wear points on the foil may reduce foil life. Similarly, as the foils may require replacement periodically, particularly in a high-speed operation, it is important to be have a mounting system to enable to the rapid replacement of the foils.

Submerged drainage in a Fourdrinier fabric is disclosed by U.S. Pat. No. 5,522,969 to Corbellini et al. entitled "Submerged Drainage Method for Forming and Dewatering a Web on a Fourdrinier Fabric" and U.S. Pat. No. 5,242,547 to Corbellini et al. entitled "Submerged Drainage System for Forming and Dewatering a Web on a Fourdrinier Fabric". Positional control of elements in papermaking apparatus is disclosed in U.S. Pat. No. 5,486,270 to Schiel entitled "Angularly Adjustable Drainage Foil for Paper Machines"; U.S. Pat. No. 5,421,961 to Miller entitled "Forming Board Position Control System"; U.S. Pat. No. 5,262,010 to Bubik et al. entitled "Dewatering Device with Adjustable Force Elements for the Web-Forming Section of a Papermaking Machine"; and U.S. Pat. No. 5,221,438 to Takeuchi et al. entitled "Supporting Device for Dewatering Elements".

U.S. Pat. No. 3,595,747 to Walser entitled "Suction Box Covers with Rows of Drainage Openings for Uniform Dewatering" and U.S. Pat. No. 5,562,807 to Baluha entitled "Cross Direction Fiber Movement and Dewatering Device".

Other prior art includes U.S. Pat. No. 4,687,549 to Kallmes entitled "Hydrofoil Blade"; U.S. Pat. No. 4,838,996 to Kallmes entitled "Hydrofoil Blade for Producing Turbulence"; and U.S. Pat. No. 3,573,159 to Sepall entitled "Deflocculation of Pulp Stock Suspension with Pressure Pulses".

OBJECTS AND SUMMARY OF THE INVENTION

It is therefore an object of this invention to provide controlled stock activity in the papermaking process, particularly in a Fourdrinier table.

It is therefore a further object of this invention to provide controlled drainage in the papermaking process, particularly in a Fourdrinier table.

It is therefore a still further object of this invention to provide controlled stock activity decoupled from controlled drainage in the papermaking process, particularly in a Fourdrinier table.

It is therefore a still further object of this invention to reduce the amount of fluid which is pumped through the forming fabric as the fluid passes over the undulated portion of a long blade in the papermaking process, particularly in a Fourdrinier table.

It is therefore a still further object of this invention to provide a blade with a variable angle and a relative fixed leading edge, particularly in a Fourdrinier table.

It is therefore a still further object of this invention to provide a blade which can be manufactured in elements and assembled together, and which can be easily mounted on a papermaking apparatus, particularly a Fourdrinier table.

It is therefore a still further object of this invention to provide increased resistance to wear at the wear points of a foil in the papermaking processing, particularly in a Fourdrinier table.

It is therefore a final object of this invention to control the sharpness of the path change as the fabric passes over the trail blade in the papermaking process, particularly in a Fourdrinier table.

A first aspect of this invention provides downwardly sloped atmospheric vents extending from the undulated portions of the long blade of the Fourdrinier table. This venting of the counterflow zone to atmosphere equalizes the pressure above and below the fabric and therefore controls the downward force on the fabric thereby controlling deflection with respect to the trail blade, controlling inertial activity and eliminates the vacuum or deflection of the fabric over the counterflow zone. Only gravitation force deflects the fabric, and it has been demonstrated that gravitational deflection is negligible except for very long spans. Furthermore, if the venting is limited or throttled, then deflection can be controlled in an analog manner and activity can be "tuned" for optimum sheet formation. The control of the venting can be uniform or non-uniform across the surface of the long blade for cross-machine profile control or variable drainage in the machine direction. The surface of the long blade can be indented locally or in the cross-machine direction to provide for the vents.

A second aspect of the invention uses an elevator-type configuration to raise or lower the trail blade. This controls stock activity by controlling the sharpness of the path change as the forming fabric travels over the trail blade thereby controlling the inertial activity. When a trail blade is elevated the angle formed by the oncoming fabric and the trail blade surface is maximized. This maximizes the rapid directional change of the fabric and therefore maximizes the inertial activity. Conversely, when the trail blade is lowered, the angle is minimized, and the inertial activity is decreased or eliminated. If the tail of the long lead blade is high enough such that the fabric lands on it as the trail blade is lowered the effect is enhanced.

Additionally, in the second aspect of the invention, successive blades can be cascaded so that the trail blade of the first pair becomes the lead blade of the second pair, etc. As elevations of successive blades are changed, the activity generated over the entire apparatus is affected. Activity can therefore be finely tuned to desired levels. As the path of the fabric determines the effectiveness of the device, it can be used with any length blade, and can be used in conjunction with other control devices, such as the vented blades of the first aspect of this invention.

A third aspect of this invention inclines the blade or foil at a variable angle. This variable angle can be accomplished by a single elevator in the front or rear of the blade in combination with either a hinge or a fixed support. Alternately, the variable angle can be accomplished with a first elevator on the front and a second elevator on the rear of the blade. Additionally, the variable angle can be accomplished by taking advantage of the inherent weight and flexibility of the blade. Additionally, the blade may also include ceramic inserts at the apices of its undulated portions in order to reduce wear. Moreover, the blade is provided in two or more pieces (with the seam at a downwardly inclined portion of the undulation) and the blade is mounted using a "button-type" fixture engaging a slot of T-shaped cross section in the blade.

Traditional foil surfaces for paper machines are short in the machine direction, compared to the special designs of the VID type blades. The length of these blade s vary depending on the specific design of the top surface curvature, which can be comprised of symmetrical undulations, or more likely, skewed profiles to provide desired results.

Based on the fact that most paper machines operate under unique conditions, each blade may be designed to maximize operation and formation for the operating ranges particular to its environment. An important variable in blade design is the specific profile of the top surface. Blade length in the machine direction is dependent on the required hydrodynamic profile desired.

The hydrodynamic profiles are design ed to produce a varying pressure profile over the entire length of the blade. This profile includes both positive and negative pressure pulses that effectively cause counterflows of fluid through the forming fabric. These counterflows create a mixing action that better forms the paper sheet. The pressure pattern is design to create a net vacuum pulse, resulting in drainage of fluid after significant mixing has been induced.

Varying blade lengths that are considerably longer in the machine direction than standard drainage foils presents a manufacturing challenge in both material procurement and physical profiling in a production environment. The jointed design offers a simple, more economical way to produce long, machined foils. In many cases, material availability is limited to lengths less than what is required for the manufacture of custom designed profiles. This created the need for a sectional design.

An additional benefit of the sectional design is that it simplifies manufacturing, by allowing smaller sections to be sculpted independently, making handling and machining less cumbersome.

The joint securing the blades sections to one another is designed to create a sealed lock, so as not to effect the operating pressure and vacuum pulses created by the top surface profile. Further, the location of the joint is selected to be within a lower portion of the undulations to keep its binding and structural integrity from being affected by wear induced by the forming fabric.

The ceramic design incorporating laterally grooved beams securing ceramic components, and spaced by polyethylene sections creates several advantages over traditional ceramic assemblies, both in manufacturing and operation. In manufacturing, the size of individual sections is significantly reduced, making critical machining steps less difficult, and increasing the choices of material available for use in the application. The sectional assembly also allows for custom fitting of parts to each other.

The ceramic portions of the profile are preferably located only at the critical wear points, and therefore are not a major portion of the special blade profile. The polyethylene spacers make up most of the blade shape and because of this, several different blade profiles can be utilized simply by changing the polyethylene spacer designs. These spacer bushings are removable and thereby can be replaced with new spacers of any variation of shape.

The machine direction length of the blades since it is relatively long requires secure mounting thereof. Typically, one hold down slot is used for the typical shorter foil blades. The blades of the present application are typically much larger, and due to their operating forced involved with their design, it is desirable to secure the mounting structure by at least two or more slots, one at each end of the foil.

Note that because of the general size and weight of the foils, it makes it relatively more difficult to install and secure them to the structure in the traditionally employed manner ("T"-bars). The cylindrical "button 'T'" design allows for simple installation by creating significantly less frictional resistance between the blade and the securing mechanism. This is realized by the fact that the buttons are spaced apart on the structure, and therefore do not create a continuous contact point between the blade and the hold down. They also have diametric clearance, allowing them to follow the hold down slot in the blade as it is installed on the structure, thereby minimizing the need for strict tolerances of the slots during manufacture.

These types of hold-downs may be utilized with any foil type that has significant cross machine direction rigidity.

BRIEF DESCRIPTION OF THE DRAWINGS

Further objects and advantages of the invention will become apparent from the following description and claims, and from the accompanying drawings, wherein:

DETAILED DESCRIPTION OF THE PREFERRED EMBODIMENT

Figure 1:
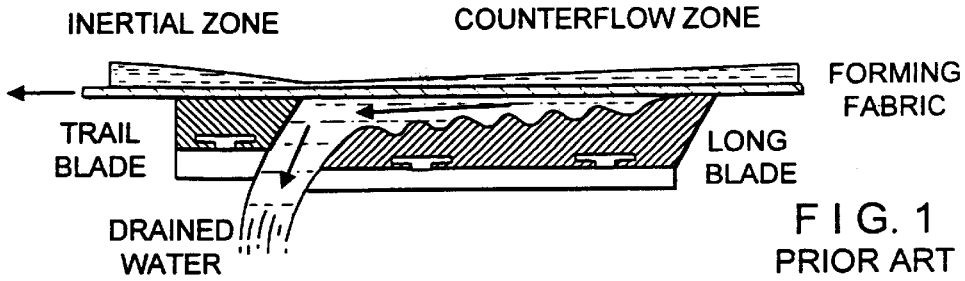
FIG. 1 PRIOR ART
FIG. 1 is a cross-sectional view of a prior art blade arrangement.
Figure 2:
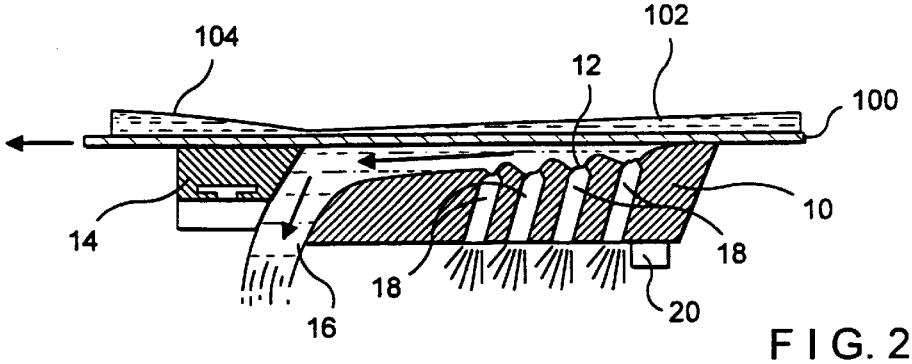
FIG. 2 is a cross-sectional view of the vents of a first aspect of the present invention.

Referring now to the drawings in detail wherein like numerals indicate like elements throughout the several views, one sees that FIG. 2 is a cross-sectional view of a first aspect of the invention. The long blade 10 has undulations 12 which generally decline in the machine direction. The forming fabric 100 traverses a path immediately above and supported by the long blade 10 and then immediately above and supported by trail blade 14. A counterflow zone 102 is formed above long blade 10 and an inertial zone 104 is formed above trail blade 14. Water is both above and below forming fabric 100 and is drained through the passageway 16 immediately between long blade 10 and trail blade 14. In the area of the undulations 12 of long blade 10, generally downwardly extending vents 18 are formed. Vents 18 allow liquid flow therethrough and equalize the pressure between the counterflow zone 102 and atmosphere. This venting of the counterflow zone 102 to atmosphere equalizes the pressure above and below the forming fabric 100 and therefore controls the downward force on the forming fabric 100 thereby controlling deflection with respect to the trail blade 14, controlling inertial activity and eliminating the vacuum or deflection of the fabric over the counterflow zone 102. Only gravitation force deflects the fabric, and it has been demonstrated that gravitational deflection is negligible except for very long spans. Furthermore, if the venting is limited or throttled, such as is illustrated by valve or throttle 20, then deflection can be controlled in an analog manner and activity can be "tuned" for optimum sheet formation. The control of the venting can be uniform or non-uniform across the surface of the long blade 10 for cross-machine profile control or variable drainage in the machine direction. The vents 18 can be throttled independently or in gangs of any combination. The surface of the long blade can be indented locally or across the cross-machine direction to provide for the vents 18.

Alternatively, the vents 18 can be connected to a cavity in which the vacuum level is controlled. Thus the pressure level between the wire and blade can be independently controlled.

Figure 3:
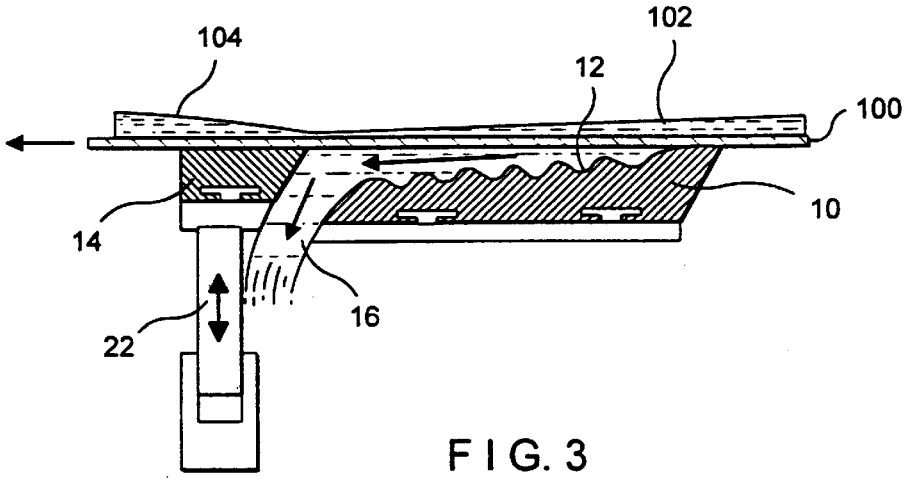
FIG. 3 is a cross-sectional view of the elevator-type configuration of a second aspect of the present invention.
Figure 4A:
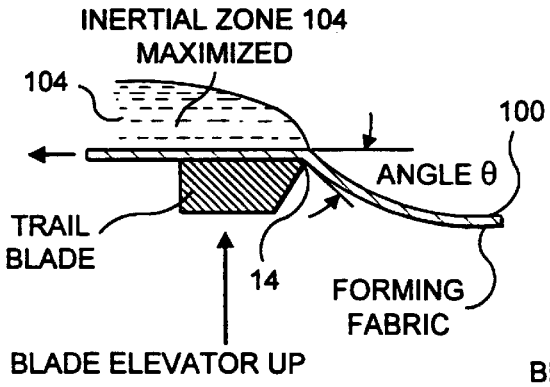
FIG. 4A is a cross-sectional view of the effect on the inertial zone by raising the trail blade in the second aspect of the invention.
Figure 4B:
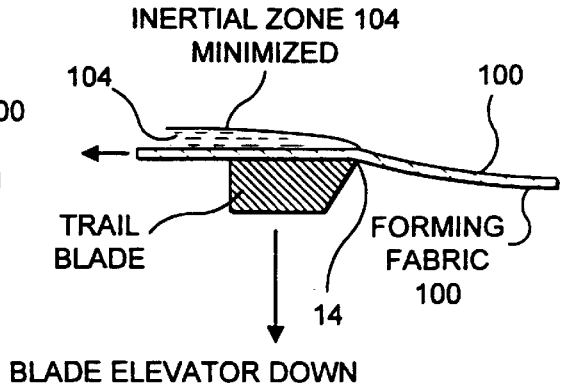
FIG. 4B is a cross-sectional view of the effect on the inertial zone by lowering the trail blade in the second aspect of the invention.

Referring now to FIG. 3, one sees a cross-sectional view of a second aspect of the invention. As in FIG. 2, the long blade 10 has undulations 12 which generally decline in the machine direction. The forming fabric 100 traverses a path immediately above and supported by the long blade 10 and then immediately above and supported by trail blade 14. A counterflow zone 102 is formed above long blade 10 and an inertial zone 104 is formed above trail blade 14. Water is both above and below forming fabric 100 and is drained through the passageway 16 immediately between long blade 10 and trail blade 14. The trail blade 14 further includes blade elevator 22 which raises and lowers trail blade 14. The vertical raising and lowering of trail blade 14 varies the angle θ (see FIG. 4A). That is, lowering trail blade 14 by way of blade elevator 22 reduces e as shown in FIG. 4B while raising trail blade 14 by way of blade elevator increases θ as shown in FIG. 4A. This controls stock activity by controlling the sharpness of the path change as the forming fabric 100 travels over the trail blade 14 thereby controlling the inertial activity. When a trail blade 14 is elevated the angle θ formed by the oncoming fabric and the trail blade surface is maximized. This maximizes the rapid directional change of the forming fabric 100 and therefore maximizes the inertial activity. Conversely, when the trail blade 14 is lowered by blade elevator 22, the angle θ is minimized, and the inertial activity is decreased or eliminated. If the tail of the long lead blade is high enough such that the forming fabric 100 lands on it as the trail blade 14 is lowered the effect is enhanced.

Additionally, in the second aspect of the invention, successive blades can be cascaded so that the trail blade of the first pair becomes the lead blade of the second pair, etc. As elevations of successive blades are changed, the activity generated over the entire apparatus is affected. Activity can therefore be finely tuned to desired levels. As the path of the fabric determines the effectiveness of the device, it can be used with any length blade, and can be used in conjunction with other control devices, such as the vented blades of the first aspect of this invention.

Figure 5:
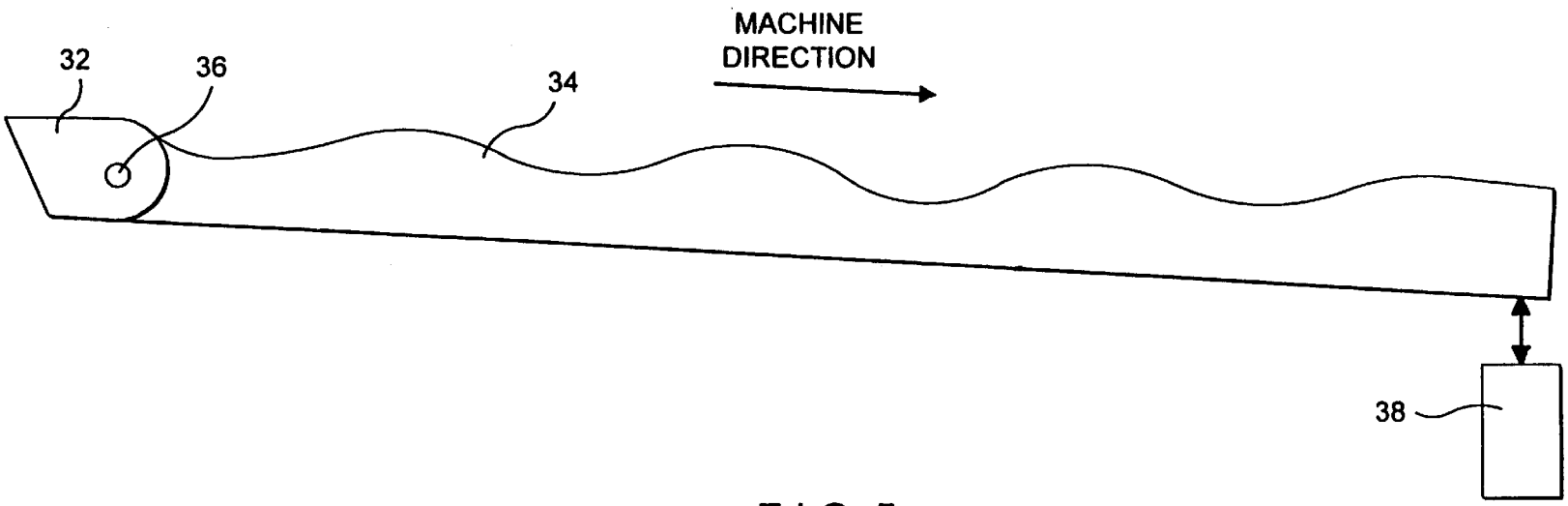
FIG. 5 is a cross-sectional view of a third aspect of the invention using a single elevator and a hinged section to achieve a variable angle of the blade.

Referring now to FIGS. 5–9C, one sees the third aspect of the invention. In particular, FIG. 5 illustrates blade or foil 30 with a fixed leading edge 32. Trailing undulated portion 34 is attached to fixed leading edge 32 by hinge 36. The angle of trailing undulated portion 34 is adjusted by vertical elevator 38. The design of FIG. 5 has the advantage that the position of the leading edge 32 is fixed, and variation of the angle of trailing undulated portion 34 does not raise or lower fixed leading edge 32.

Figure 6:
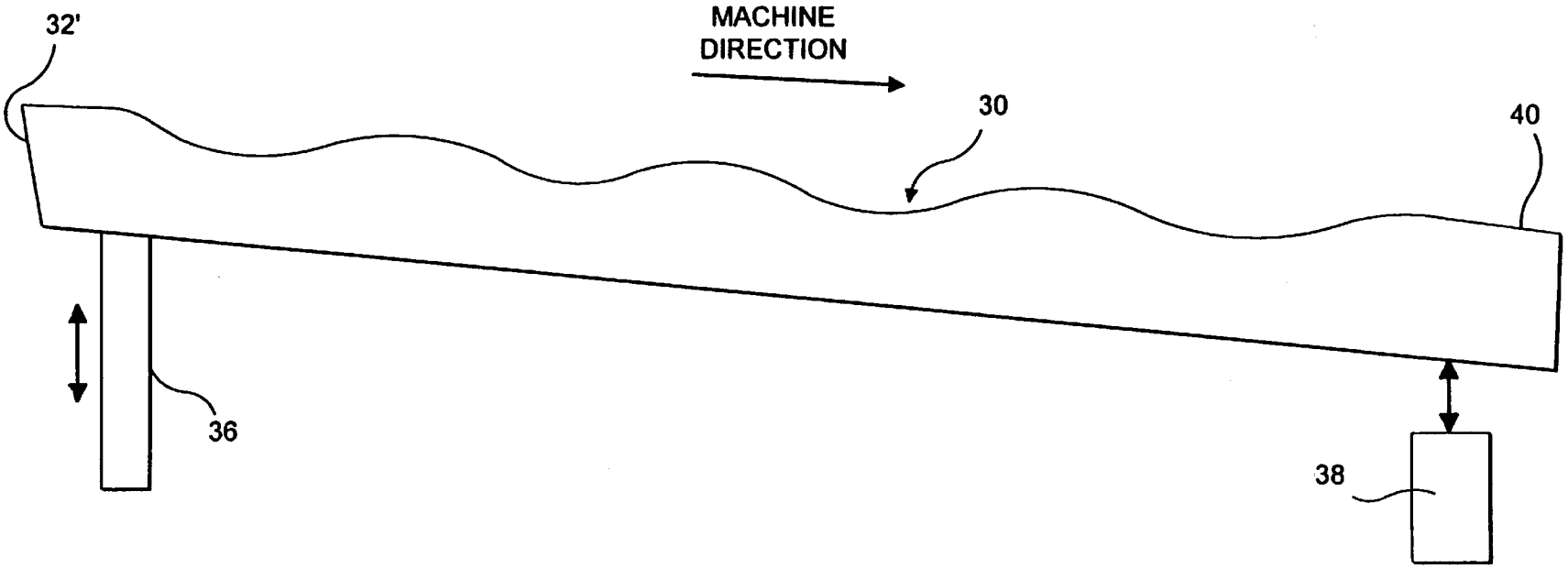
FIG. 6 is a cross-sectional view of the third aspect of the invention using an elevator and a support (which could be a second elevator) to achieve a variable angle of the blade.

FIG. 6 illustrates a similar design to FIG. 5. Blade or foil 30 is a one-piece design. The portion of blade 30 proximate to leading edge 32' is coupled to support 36 (which could be fixed or a vertical elevator) while trailing edge 40 of foil 30 is supported by vertical elevator 38. Alternately, support 36 could be a vertical elevator and support 38 could be fixed. Typically, blade 30 rests on fixed support 36 so as to allow a change of angle of blade 30 with respect to fixed support 36 as trailing edge is raised and lowered by vertical elevator 38. However, a variation of this aspect could include flexible blade 30 integral with fixed support 36. The variation of the angle of the blade 30 in response to the movement of vertical elevator could be accommodated by the inherent flexibility of the blade.

Figure 7A:
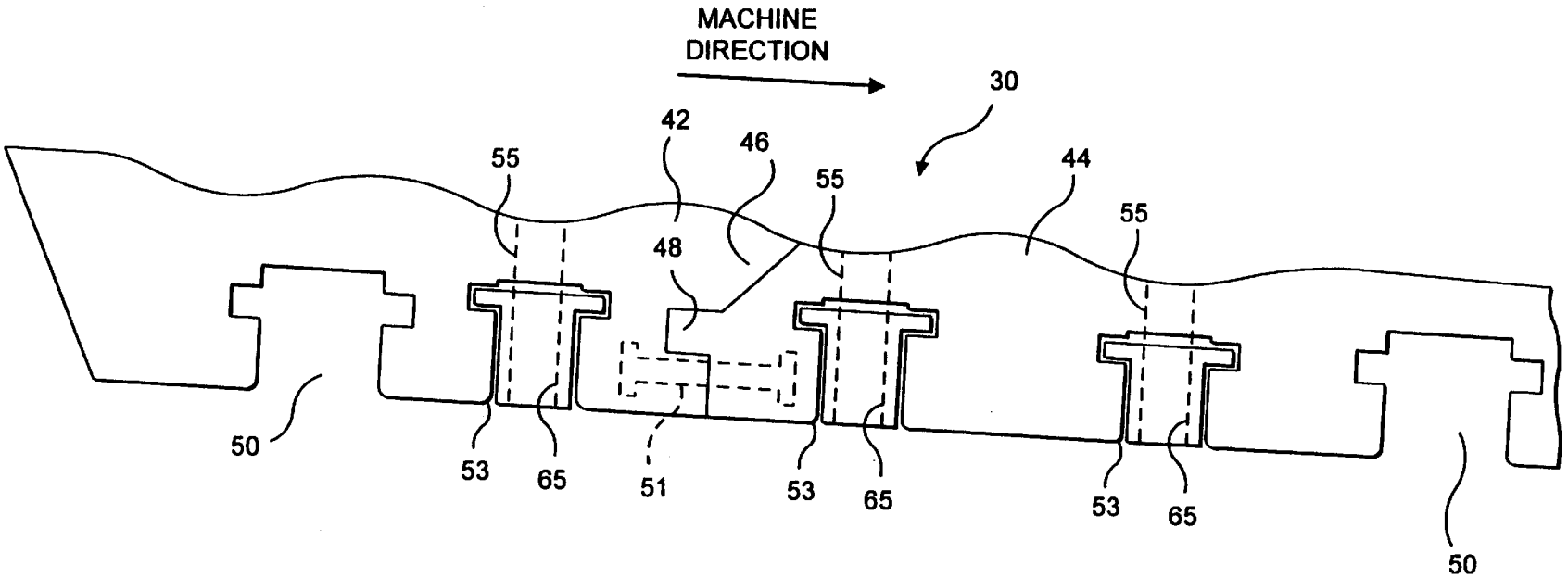
FIG. 7A is a cross-sectional view of the third aspect of the invention illustrating a two-piece design and the mounting slots of a "T" cross section.
Figure 8:
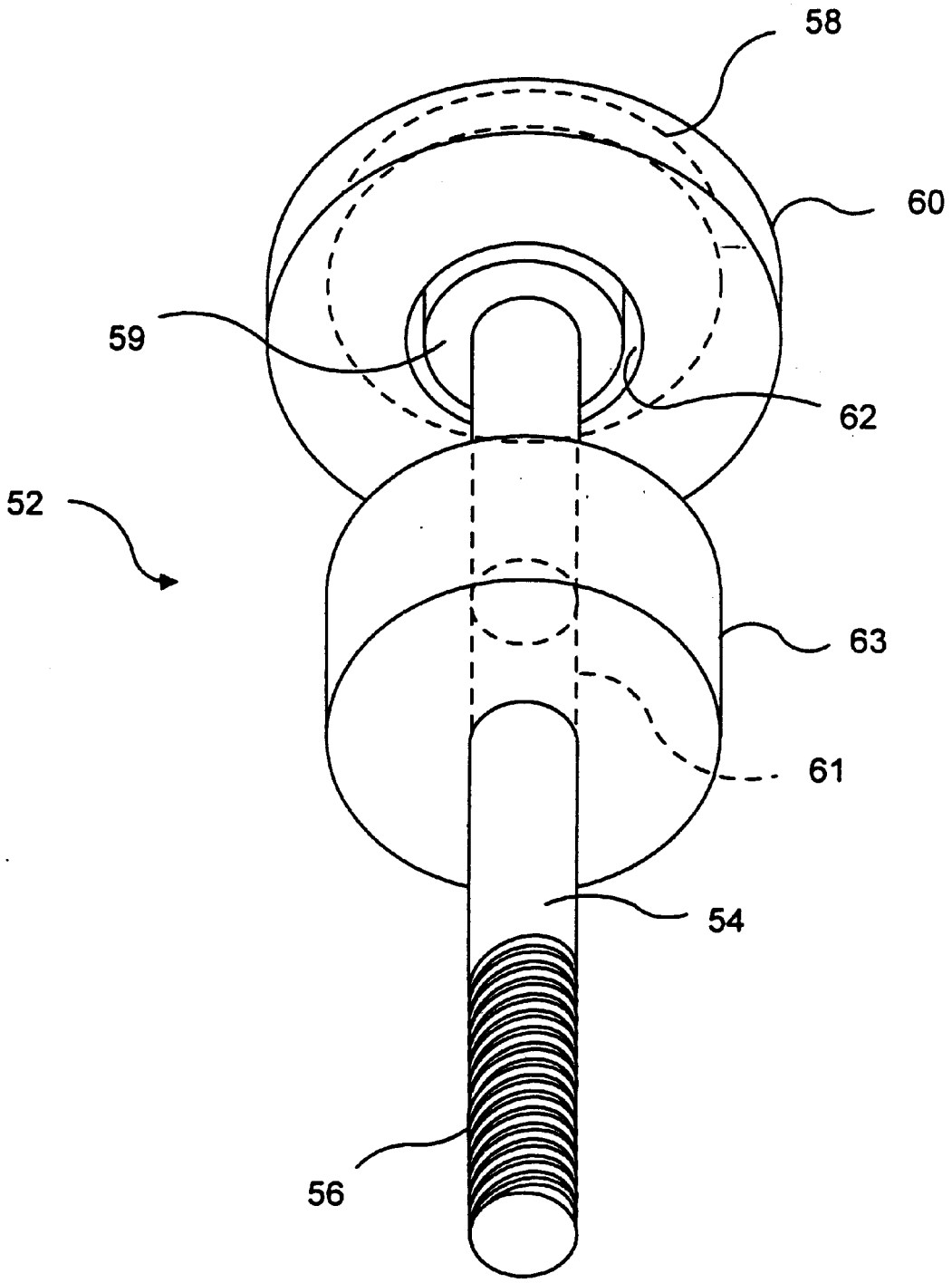
FIG. 8 is a perspective view of the mounting button used for the mounting system in combination with the mounting slots of FIG. 7A.

FIG. 7A illustrates the two (or multiple) piece blade design. Blade 30 is composed of a forward section 42 and a rearward section 44. Seam 46 between forward section 42 and rearward section 44 is formed from an angled portion 46 extending from a downward extending portion of an undulation (with respect to the machine direction, so that the felt or liquid 'not shown' does not urge the forward section 42 and the rearward section 44 apart) and a notched portion 48. The notched portion 48 is shown with a male portion in rearward section 44 and a female portion in forward section 42. The forward section 42 and the rearward section 44 are held together by bolts 51 (in phantom) or similar fastening devices. The lower portion of both forward section 42 and rearward section 44 include mounting slots 50 of a T-shaped cross section. Mounting slots 50 are used to engage mounting buttons 52 as shown in FIG. 8. Additionally, the lower portion of both forward section 42 and rearward section 44 include vent slots 53 of a T-shaped cross section. Vent slots 53 are in communication with vents 55 which are in communication with the troughs of the undulations of the upper surface of forward section 42 and rearward section 44. Vent slots 53 engage variable plug strips 57 which can be vertically adjusted either to align apertures 65 of variable plug strips 57 with vents 55 or to block vents 55 with solid portions of variable plug strips 57.

Figure 7B:
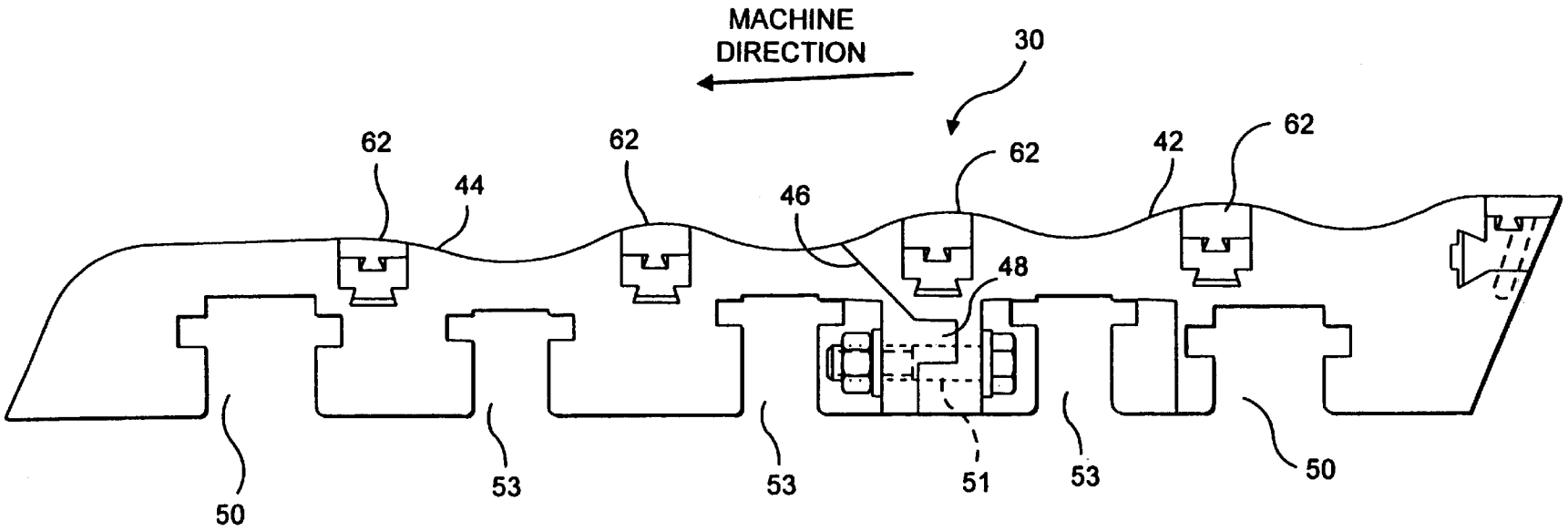
FIG. 7B is a cross-sectional view of an alternative embodiment of the third aspect of the invention, illustrating the use of ceramic inserts at the apices of the undulations.

FIG. 7B shows ceramic inserts 62 at the apices of the undulations of blade 30 in a design otherwise similar to that shown in FIG. 7A.

FIG. 8 illustrates mounting button 52. Mounting button 52 includes a cylindrical stem 54 with a lower threaded portion 56. Upper circular cap 58 is integral with intermediate circular portion 59 and cylindrical stem 54. Washer 60 of a hollow cylindrical shape loosely engages intermediate circular portion 59 immediately below upper circular cap 58. As can be seen from the phantom lines in FIG. 8, the inner wall 62 of washer 60 is outward from intermediate circular portion 59 thereby allowing "play" between washer 60 and intermediate circular portion 59. Likewise, cylindrical stem 54 passes through central aperture 61 of cylindrical spacer bushing 63 which is downwardly adjacent from washer 60.

Mounting buttons 52 are secured to a frame (not shown) by lower threaded portions 56. Upper cylindrical cap 58 and washer 60 then engage the T-shaped mounting slots 50 (see FIG. 7A).

Figure 9A:
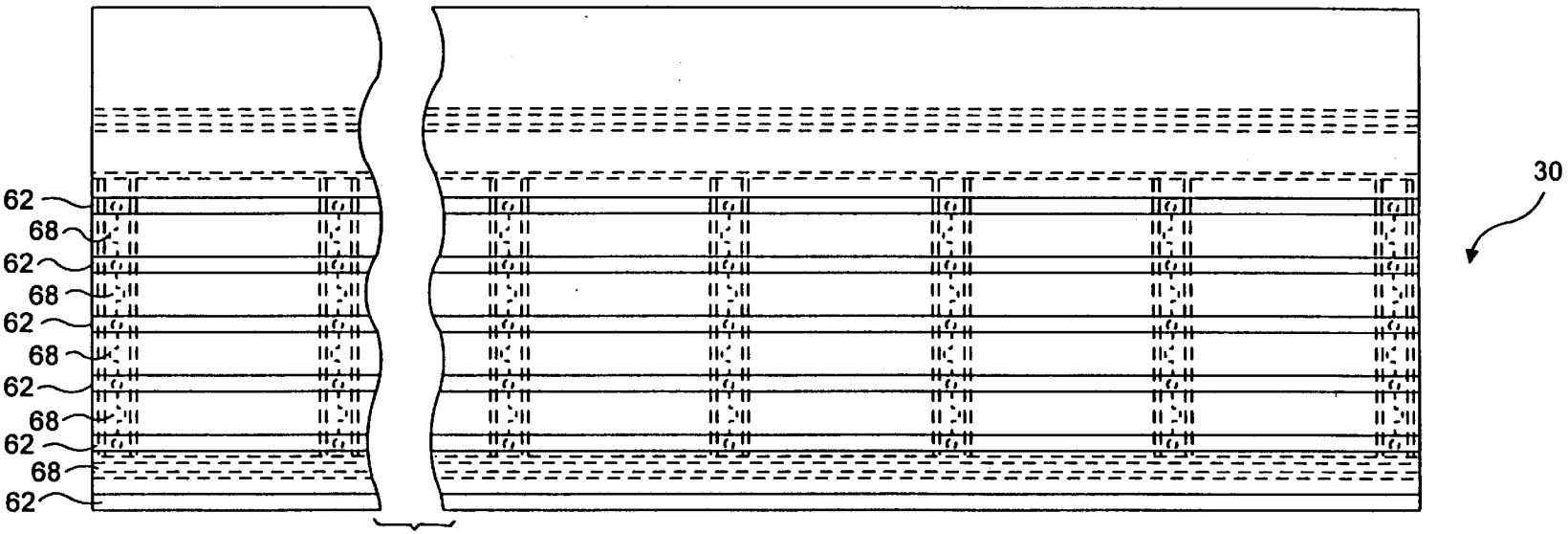
FIG. 9A is a top view of the third aspect of the invention showing the modular design for use with the ceramic inserts at wear points.
Figure 9B:
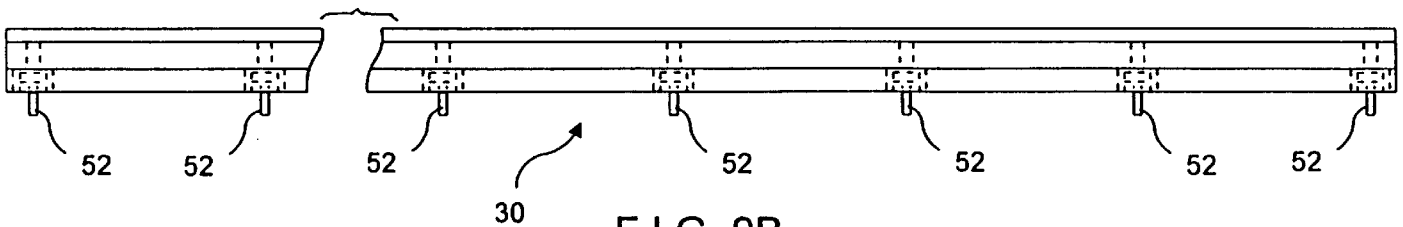
FIG. 9B is a front view of the third aspect of the invention showing the modular design for use with the ceramic inserts at wear points.
Figure 9C:
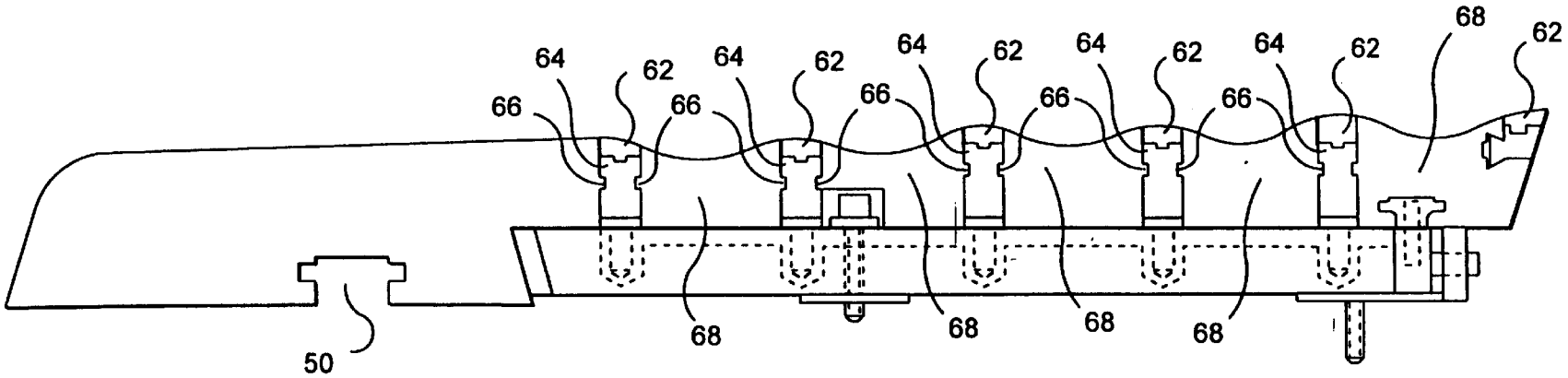
FIG. 9C is a side cross sectional view of the third aspect of the invention showing the modular design for use with the ceramic inserts at wear points.

FIGS. 9A–9C illustrate a modular design with ceramic inserts 62 at the apices of the undulations of blade 30. Ceramic inserts 62 are supported by laterally grooved beams 64. Beams 64 include lateral grooves 66 which guide the trough portions 68 into place to form the modular composite blade 30.

Thus the several aforementioned objects and advantages are most effectively attained. Although preferred embodiments of the invention have been disclosed and described in detail herein, it should be understood that this invention is in no sense limited thereby and its scope is to be determined by that of the appended claims.

What is claimed is:

1. A papermaking apparatus comprising an undulated blade with a plurality of undulations wherein apices of said undulated blade are formed of ceramic components and troughs of said undulated blade are formed of plastic components, further including lateral beams placed within the plastic components of the blade, each said ceramic component being formed above and supported by a respective said lateral beam, and said plastic components having lateral slots for receiving a respective said lateral beam and having means engagable with said respective beam so as to maintain said beams in said slots.

2. The invention in accordance with claim 1 wherein said engagement means is a dove tail and groove.

3. The invention in accordance with claim 1 wherein said engagement means comprises a lateral groove and flange.

4. The invention in accordance with claim 1 wherein said blade includes a forward section and a rearward section, said forward and rearward sections having mating elements whereby said forward section and said rearward section form said blade as a single piece.

* * * * *